United States Patent [19]

Davis et al.

[11] 4,100,907

[45] Jul. 18, 1978

[54] START-TO-RUN CIRCUIT FOR AN ELECTRONIC IGNITION SYSTEM

[75] Inventors: William F. Davis; Wilson David Pace, both of Tempe, Ariz.

[73] Assignee: Motorola, Inc., Schaumburg, Ill.

[21] Appl. No.: 702,155

[22] Filed: Jul. 2, 1976

[51] Int. Cl.[2] ..... F02P 11/00; F02P 9/00; F02P 15/00

[52] U.S. Cl. ..... 123/148 S; 123/139 BG; 123/148 E

[58] Field of Search ..... 123/32 EA, 32 AE, 102, 123/117 R, 179 BG, 148 S, 32 EK, 198 DC, 148 E, 146.5 D, 179 B

[56] References Cited

U.S. PATENT DOCUMENTS

| | | | |
|---|---|---|---|
| 2,173,869 | 9/1939 | Weston | 123/179 BG |
| 2,888,914 | 6/1959 | Sherman | 123/179 BG |
| 3,180,997 | 4/1965 | Short et al. | 123/179 BG |
| 3,620,200 | 11/1971 | Stephens | 123/179 BG |
| 3,745,985 | 7/1973 | Höhne | 123/148 S |
| 3,854,466 | 12/1974 | Steinberg et al. | 123/148 S |
| 4,036,199 | 7/1977 | Chateau | 123/148 S |
| 4,041,912 | 8/1977 | Sessions | 123/148 E |
| 4,043,302 | 8/1977 | Sessions | 123/148 E |

*Primary Examiner*—Charles J. Myhre
*Assistant Examiner*—R. A. Nelli
*Attorney, Agent, or Firm*—Michael D. Bingham

[57] ABSTRACT

In an electronic ignition system for controlling engine spark and firing thereof, a circuit is provided for causing the current through the ignition coil to have a greater value during starting of the engine than the current therethrough when the engine is running normally. The circuit is operated in conjunction with control of a current interrupt circuit of the ignition system. Moreover, the start-to-run circuit prevents premature engine spark, which might otherwise occur if the ignition system is switched from a start mode to a run mode just prior to desired engine firing, by controlling the transition time of the current through the coil from the start value to run value.

17 Claims, 6 Drawing Figures

START-TO-RUN CIRCUIT FOR AN ELECTRONIC IGNITION SYSTEM

CROSS REFERENCE TO A RELATED PATENT

The subject matter of the subject invention is related to the subject matter of a patent entitled, "Improved Solid State Ignition System and Method for Regulating the Dwell Time Thereof," U.S. Pat. No. 4,043,302 by Douglas C. Session, which is assigned to Motorola, Inc.

BACKGROUND OF THE INVENTION

This invention relates to high energy ignition systems and particularly to a circuit for controlling the starting and ignition of an internal combustion engine while preventing a spark potential from being developed which could otherwise cause untimely ignition in the engine between starting thereof and the normal operating condition.

In mechanical ignition system (points, condensor, etc.) presently employed on many automobiles, the magnitude of charging current through the ignition coil is limited by a ballast resistor to a maximum value. Furthermore, to facilitate engine start up, in response to a start command signal (produced by turning the ignition switch to a start position) a start mode is determined and the ballast resistor short circuited. Subsequently, the charging current is increased during this start mode until it is terminated (release of the start position on the ignition switch). The ballast resistor is then reconnected into the ignition circuit and again limits the current to the maximum value between firing command signals.

However, in contemporary electronic ignition systems no such provisions have been presently made for providing a starting current of greater magnitude than the run mode current. Presently, the magnitude of the current in the start mode is maintained essentially the same as the run mode current. Hence, under some starting conditions, i.e., a weak battery, cold weather, these electronic ignition systems may have poor starting characteristics.

In variable dwell high energy electronic systems now being proposed, it is very desirous to provide a different start current than the normal run current to improve starting of the engine. For example, in such ignition systems where the normal run current is approximately six amps, it is desirous to increase the current during starting to approximately nine amps. Then, after engine starting, the maximum current through the ignition coil would be decreased to the running mode value.

However, another problem occurs in these solid state ignition systems which must be prevented if a higher magnitude of current is generated during the start mode. For instance, as long as the start command signal is terminated in synchronism with the fire command (the discharging of the ignition), no problem is created by the difference in magnitudes of the starting current with respect to the normal running mode current. However, if the start command is terminated, by releasing the ignition switch from the start position, when the current to the coil is in a limited condition, just prior to the next firing command, the instantaneous transition from the start current to the run current, if sufficiently fast, could induce a voltage into the secondary of the ignition coil. If this were to happen, a premature spark could be derived which could cause premature firing in the engine. This spark potential, which acts as an excessive spark retardation, could seriously degrade engine start performance or more seriously, damage the engine.

Thus, there exists a need to prevent premature sparking in the engine due to the transition between start mode and run mode.

SUMMARY OF THE INVENTION

Accordingly, it is an object of this invention to provide an improved start to run circuit and method for electronic solid state ignition systems.

Another object of this invention is to provide a start-to-run circuit that is suitable for manufacture in integrated circuit form and is compatible with contemporary solid state ignition systems.

Still another object of the invention is to provide a start-to-run circuit which provides a start current of higher value than the run current provided to an ignition coil coupled to the ignition system upon a start command signal.

A further object of the invention is to provide a start-to-run circuit for an electronic solid state ignition system which inhibits false firing in the internal combustion engine when the ignition system is caused to be switched from a start mode to a run mode.

The start-to-run circuit is suitable to be utilized with an electronic ignition system to provide, upon command, a start current in the primary coil of the engine having a different value than the normal run current provided in the same during normal engine operating conditions. The start current is provided for improved starting in high energy ignition systems for internal combustion engines. Moreover, the start-to-run circuit provides for causing the current in the coil between transition from a start mode to a run mode to decrease at a predetermined manner to prevent premature firing of the engine. The start-to-run circuit is operatively coupled to a feedback circuit of the ignition system. In normal operation of the engine, the feedback circuit is employed to limit the current provided in the primary of the ignition coil to a maximum limit or value. Upon a start command, the start-to-run circuit causes the feedback circuit to permit a higher value of current during the duration of the start command. Upon removal of the start command the start to run circuit limits transition time between the start current to the run current value to thereby prevent a premature spark potential to be developed by the coil. Thus, firing of the engine cannot occur if the engine ignition system should be switched from a start mode to a run mode just prior to the normal firing command when the current through the ignition coil is at or near a limited value as caused by the feedback circuit.

DETAILED DESCRIPTION OF THE INVENTION

Figure 1:
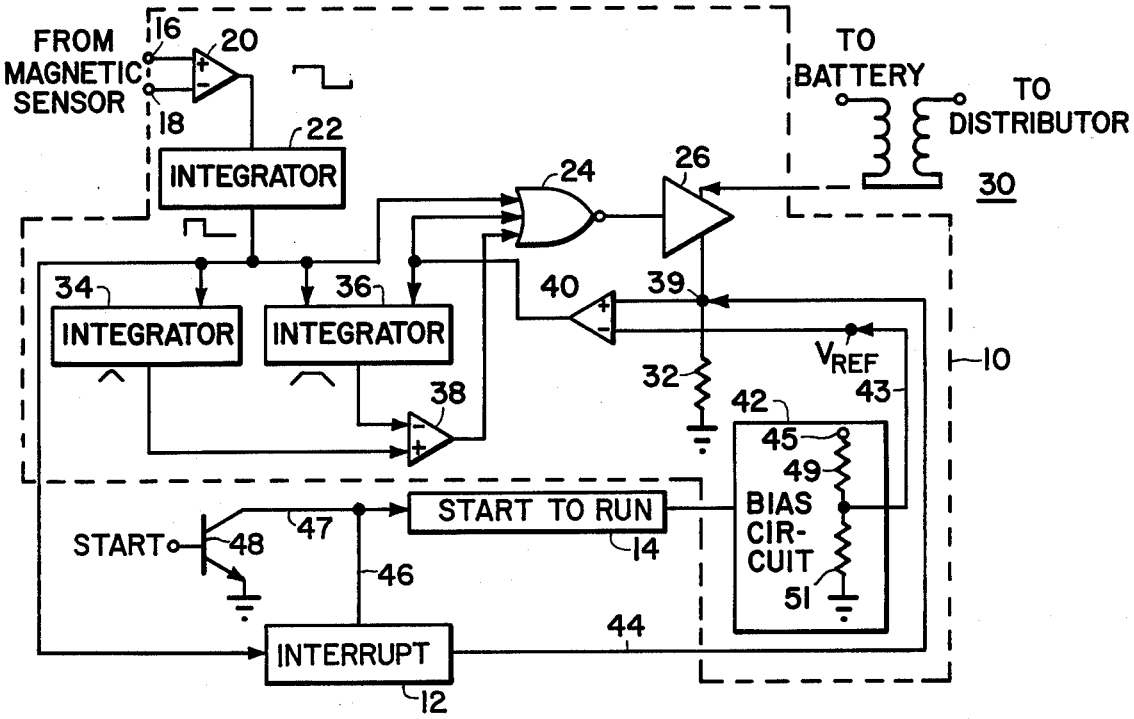
FIG. 1 is a partial block and schematic diagram of an electronic ignition system including a start to run circuit of the present invention.

Referring to FIG. 1, there is shown an electronic ignition system 10 to which current interrupt circuit 12 and start-to-run-circuit 14 of the present invention are coupled thereto. Ignition system 10 is adapted to receive timing signals generated in timed relationship to the engine operating speed. The timing signals are generated in the distributor, as is well known, and applied to input terminal 16 and 18 of ignition system 10. Ignition system 10 is described in the afore-referenced patent of Douglas C. Sessions and is briefly reviewed herein.

The timing signals applied to the input terminals of comparator 20 are of generally sinusoidal shape. In response to the applied timing signals, comparator 20 provides an essentially 50% duty cycle square wave signal at the output thereof. The output from comparator 20 is applied to the input of integrator circuit 22, which may be an input quarter cycle timing circuit. As understood, integrator circuit 22 provides an output monopulse signal during the first quarter cycle of the applied input signal from comparator 20. The output of integrator circuit 22 is applied to a plurality of circuits, one of which is NOR circuit 24. Thus, in response to the pulse applied to one input thereof, NOR circuit 24, is inhibited and positively renders amplifier 26 nonconductive during the first quarter cycle of the applied timing signals. Therefore, no current is generated in the output of amplifier 26 which is connected in series between the primary winding of ignition coil 30 and sense resistor 32. As will be explained in greater detail, in response to the leading edge of the monopulse signal for example, ignition coil 30 will then be discharged to provide the spark potential at the secondary winding thereof to ignite the spark plugs in timed relationship to the engine. The output of integrator circuit 22 is also applied to integrator circuits 34 and 36 the outputs thereof, respectively, being coupled to the noninverting and inverting input terminals of comparator 38. Integrator circuit 34 produces an output signal which ramps upwards during the first quarter cycle and downwards during the remaining portion of the applied timing signal duration. Also, integrator 36 provides a variable threshold voltage of which the magnitude is linearly varied in response to engine rpm. As long as the output signal from integrator circuit 34 remains greater than the magnitude of the output signal from integrator 36, an output signal is derived at the output of comparator 38 which is applied to a second input terminal of NOR gate 24 and amplifier 26 remains inhibited. However, when the magnitude of the output signal from integrator circuit 34 becomes substantially equal to or less than the output of integrator 36, comparator 38 changes sense such that amplifier 26 is rendered conductive and energization current is provided through the primary winding of ignition coil 30. The energization coil current flowing through ignition coil 30 also flows through sense resistor 32 and establishes a voltage magnitude thereacross which is proportional to the magnitude of the current generated by amplifier 26. The voltage developed across sense resistor 32 is applied to the noninverting input terminal of comparator 40 of which the output thereof is applied to both another input of integrator circuit 36 and a additional input terminal of NOR gate 24. The noninverting input terminal of comparator 40 under normal operating conditions is supplied an operating reference voltage ($V_{REF}$) established by bias circuit 42 via lead 43. In normal operation, the current through the amplifier 26 is caused to increase until the voltage generated across sense resistor 32 becomes greater than the reference voltage ($V_{REF}$) such that the output voltage of comparator 40 changes sense. In response thereto, NOR gate 24 will become increasingly inhibited thereby rendering amplifier 26 increasingly nonconductive for limiting the current through the amplifier to a predetermined magnitude. Simultaneously, the output of comparator 40 causes the output signal from integrator 36 to be decreased at a predetermined rate. This current limiting condition through ignition coil 30 is maintained until the next timing signal is applied to comparator 20 which produces another quarter cycle monopulse output signal from integrator circuit 22. The monopulse signal from integrator circuit 22 then inhibits NOR gate 24 and renders amplifier 26 nonconductive which discharges the ignition coil to produce the spark potential required to operate the engine. As described in the Sessions' patent, the magnitude of the variable threshold voltage from integrator circuit 36 is caused to be constant as long as the engine rpm is maintained constant. However, if the engine speed should either increase or decrease, the magnitude of the threshold output voltage from integrator circuit 36 is caused to be respectively increased or decreased such that the dwell of the ignition system remains a constant percentage of the total firing cycle.

It should become apparent to the reader after the foregoing discussions that the current through ignition coil 30 can be either increased or decreased by increasing or decreasing $V_{REF}$. For example, if the reference voltage is increased to a greater value, the magnitude of current produced by amplifier 26 and conducted through sense resistor 32 would increase until the magnitude of the voltage across sense resistor 32 becomes substantially equal to the new level of reference voltage. In a like manner, the magnitude of the current through ignition coil 30 can be reduced by reducing the reference voltage to comparator 40.

The output of integrator circuit 22 is also applied to current interrupt circuit 12 which has a first output coupled to sense resistor 32, via lead 44, and is also coupled via lead 46, to start transistor 48 and start-to-run circuit 14 respectively. The purpose of current interrupt circuit 12 is to cause ignition system 10 to become latched in an off condition when the engine RPM is reduced below a predetermined speed to prevent current from being conducted through ignition coil 30 for an excessive time interval.

Figure 2:
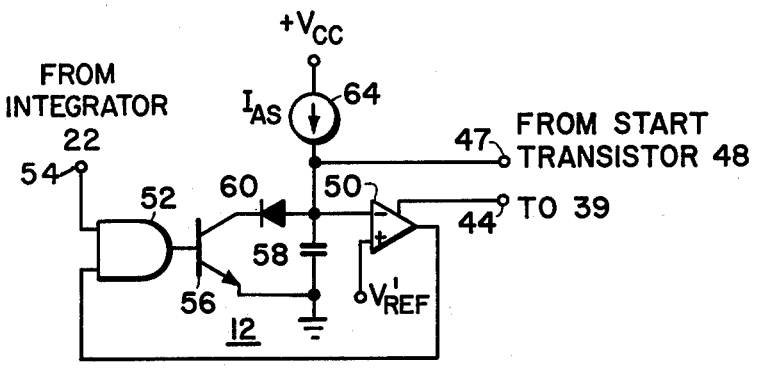
FIG. 2 is a simplified schematic diagram of a current interrupt circuit which is included in the ignition system of FIG. 1.
Figure 4:
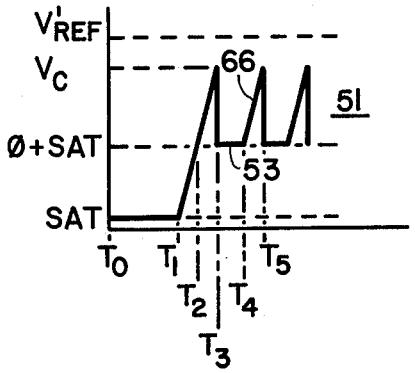
FIG. 4 illustrates a waveform useful for explaining the operation of the current interrupt and start to run circuit of the embodiment of the invention.

Referring to FIGS. 2 and 4, there is generally shown a circuit to provide the functions of current interrupt circuit 12. If it is assumed that under normal operating conditions, an output signal is provided at the output of comparator 50 to one input terminal of AND gate 52, in response to the monopulse signal from integrator circuit 22 (at the beginning of each firing cycle) applied to input terminal 54, transistor 56 will be gated on. With transistor 56 rendered conductive, capacitor 58 is discharged through diode 60 and transistor 56 to a voltage level equal to the saturation voltage of the transistor and the diode voltage, $\phi$, illustrated as portion 53 of waveform 51 of FIG. 4. Because the voltage magnitude across capacitor 58 is less than the reference voltage applied to noninverting terminal of comparator 50, $V_{REF}'$, an output signal is produced at the output of the comparator and the initial assumption is correct. Simultaneously, the output of comparator 50, to terminal 39, has no effect on the operation of ignition system 10. As long as the monopulse output signal from integrator circuit 22 is applied to current interrupt circuit 12 the voltage across capacitor 58 is maintained at the saturation voltage of transistor 56 plus the diode voltage of diode 60, portion 53 of waveform 51. During normal operating conditions, for example, at time $T_4$, in response to the termination of the monopulse signal, capacitor 58 is charged at a predetermined rate corresponding to charging current, $I_{AS}$, from constant current source 64 as is illustrated by waveform portion 66. During the firing cycle, between time intervals $T_3$ and $T_5$, the voltage across capacitor 58 increases to a predetermined value, $V_C$. In response to the next timing signal applied to comparator 20, the next generated monopulse signal again causes discharge of capacitor 58 at $T_5$. As long as the engine speed is above a predetermined RPM, the frequency of the firing cycle is of short enough duration to maintain the voltage across capacitor 58, $V_C$, less than the voltage, $V_{REF}'$. However, as the engine speed is reduced, the frequency of the timing cycle is decreased which provides a longer charging period of capacitor 58. Thus, the voltage developed across capacitor 58, $V_C$, will at predetermined engine RPM, reach the value of the magnitude of the reference voltage applied to the non-inverting terminal of comparator 50 such that the comparator trips and latches the output "off" (a "0" output signal to the input of AND gate 52). Until current interrupt circuit 12 is unlatched, it will not be responsive to any further signal applied thereto from integrator circuit 22 and the voltage across capacitor 58 will be at a magnitude that is essentially the reference voltage, $V_{REF}'$.

In response to current interrupt circuit 12 being in a latched condition, the output via lead 44 from the circuit will cause comparator 40 to trip ($V_{REF}' > V_{REF}$) thereby rendering amplifier 26 nonconductive such that ignition coil 30 can no longer be charged and discharged and the engine is subsequently shut off.

One way to unlatch current interrupt circuit 12 is for a start command to be applied to the base of transistor 48, such as by an operator turning the ignition switch to a start position. Start transistor 48, when rendered conductive, is in a saturated condition such that the voltage across capacitor 58 is pulled down to a level which is equal to the saturation voltage of the start transistor, illustrated between times $T_0$ and $T_1$ of FIG. 4. When the start command is removed, the voltage across capacitor 58 will once again begin to ramp upward at a rate proportional to the current, $I_{AS}$, beginning at time $T_1$. If the engine is then in a run condition or run mode, normal operation is once again obtained and capacitor 58 is charged and discharged during each firing cycle as previously described.

As will be explained hereinafter, in response to the foregoing start command, start-to-run circuit 14 is rendered operative to cause the reference voltage, $V_{REF}$, established by bias circuit 42 to be increased. Therefore, as long as the start command is generated, the current produced through the ignition coil will increase to a higher value during the start mode which is a function of the increased reference voltage applied to comparator 40.

Figure 3:
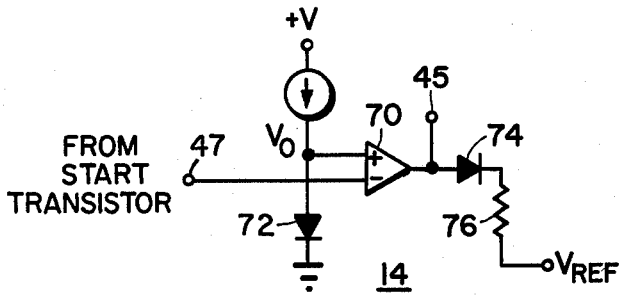
FIG. 3 is a simplified schematic diagram representing the start-to-run-circuit of the embodiment of the present invention.
Figure 5:
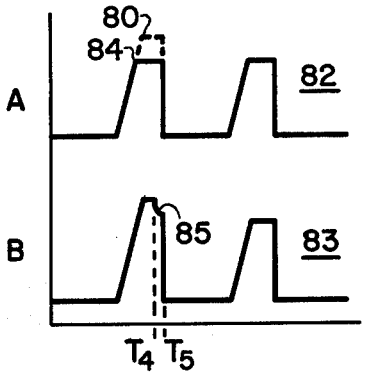
FIG. 5 illustrates waveforms useful in explaining the operation of the solid state ignition system including the start to run circuit of the embodiment of the invention.

Referring now to FIGS. 3, 4 and 5, the operation of start-to-run circuit 14 will be fully explained. Under normal operating conditions, in a run mode, the voltage across capacitor 58 of current interrupt circuit 12 is charged and discharged between the values $V_C$ and $\phi +$ SAT, as illustrated in FIG. 4. Therefore, the magnitude of voltage appearing at terminal 47 is greater than the magnitude of the voltage, $V_D$, which is provided at the noninverting input terminal of comparator 70 of start to run circuit 14 illustrated in FIG. 3. Hence, there will be no output from comparator 70 and start to run circuit 14 is rendered nonoperative. However, in response to a start signal being applied to the base of start transistor 48, the voltage appearing at the inverting input terminal of comparator 70 is caused to be less than the voltage $V_D$, which appears across diode 72 and comparator 70, which acts as a semiconductor switch, is tripped. At this time, an output current is derived which renders diode 74 conductive. With diode 74 conductive, resistance 76 is effectively placed in parallel between terminal 45, illustrated in bias circuit 42, and the reference voltage terminal. Hence, the reference voltage, $V_{REF}$, is increased to a higher level which increases the value of the limit current produced through ignition coil 30. However, in response to the removal of the start command signal at the base of transistor 48, capacitor 50 is once again charged and discharged with the minimum voltage appearing thereacross being greater than the voltage established across diode 72. Hence, the output of comparator 70 once again changes to its original state and resistor 76 is no longer in parallel with resistor 49 of bias circuit 42, and the reference voltage decreases to its original value.

Referring to FIG. 5A, under starting conditions, the current through ignition coil 30 is increased as previously discussed to a new limited value shown as portion 80 of waveform 82. In response to a timing signal being generated, for example, while the engine is cranking, amplifier 26 is rendered nonconductive at time $T_5$ which discharges ignition coil 30 to provide the necessary spark to cause firing in the engine. Operation of the ignition system would thus continue as previously explained.

Referring to FIG. 5B, if the driver should unknowingly remove the start signal when the primary coil current is in the higher current limit mode (time $T_4$) before the next fire command at time $T_5$, there will be a transition from the start limit mode to the normal run value of the current, portion 85 of waveform 83. If this transition is sufficiently fast, a voltage will be induced into the secondary of the ignition coil causing a premature spark. Since this premature spark could occur significantly before the fire time (time $T_5$) the spark acts as an excessive spark retardation which could seriously degrade engine start performance or more seriously damage the engine. To prevent the above from occurring, the transition time must be caused to be less than a minimum value required to induce spark in the secondary of the ignition coil. Therefore, by controlling the rate of decrease of the reference voltage applied to comparator 40, the transition period between start current limiting to run current limiting can be controlled to prevent premature firing of the engine.

Referring to FIGS. 2 and 3, immediately upon removal of the start signal ($T_1$), capacitor 58 of current interrupt circuit 12 begins to ramp at a rate proportional to $I_{AS}/C_{58}$. As the increasing voltage across capacitor 58 is applied to the inverting terminal of comparator 70, the output will decrease at a rate proportional to charging of the capacitor and the gain of comparator 70. Thus, the magnitude of $V_{REF}$ is caused to decrease at the rate that the output of comparator 70 decreases. By controlling the gain of comparator 70, the transition time between the start mode to the run mode can be maintained at a well defined rate such that the current limit loop is reduced at a rate to prevent firing in the engine.

Figure 6:
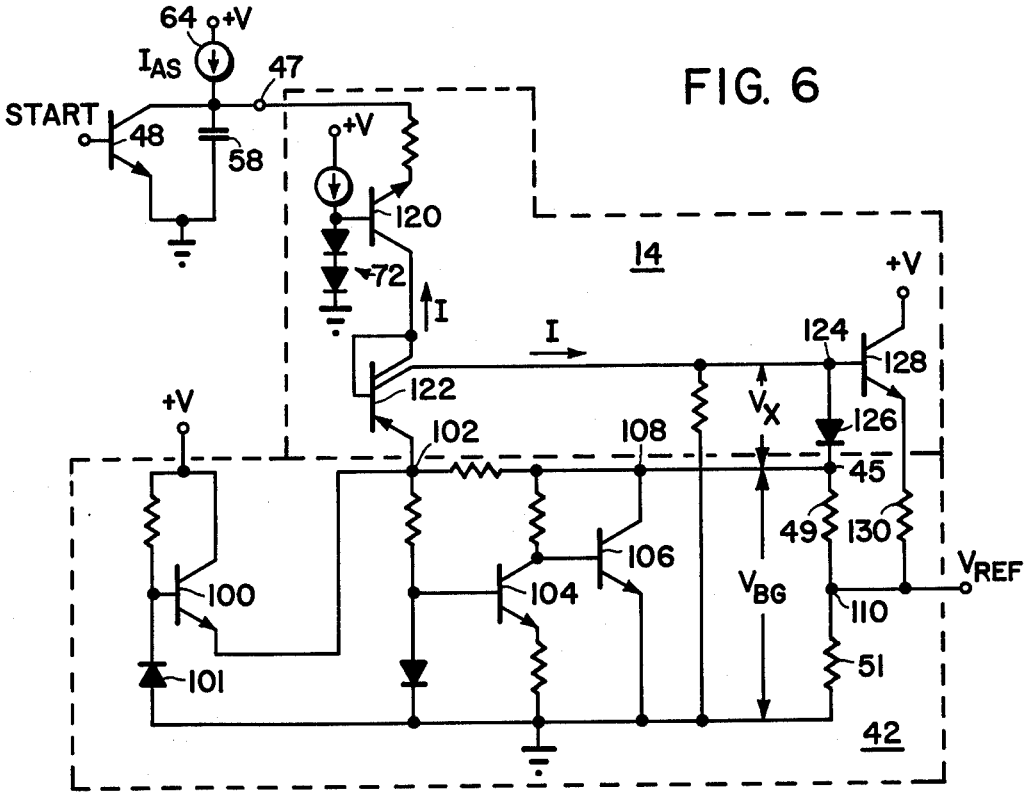
FIG. 6 is a schematic diagram of the start-to-run and bias circuit of the invention.

Referring now to FIG. 6, there is shown a preferred embodiment of bias current 42 and start-to-run circuit 14 of the present invention. Bias circuit 42 is shown as comprising transistor 100 connected with Zener diode 101 and coupled in an emitter follower configuration to junction 102 to provide a substantially constant bias voltage thereat. The connection of transistors 104 and 106 between terminals 102 and 108 respectively provide for establishing a zero temperature coefficient voltage, $V_{BG}$ at terminal 45. The resistive divider network comprising resistors 49 and 51 provide a zero temperature coefficient reference voltage at junction 110 therebetween. Thus, during normal run mode, the current through amplifier 26 and ignition coil 30 is limited to this predetermined reference value, as shown by portion 84 of waveform 82.

As described above, in normal run conditions, the voltage across capacitor 58 of current interrupt circuit 12 which is applied to terminal 47 of start-to-run circuit 14 is of sufficient magnitude to bias transistor 120 as well as transistor 122 nonconductive. However, in response to the ignition system being in a start mode (the application of a start signal to the base electrode of transistor 48) transistor 120 is rendered conductive as well as transistor 122. Transistor 122 being a multiple collector PNP transistor, provides currents to transistor 120 and to node 124 of substantially equal magnitudes, I. Thus, diode 126 and transistor 128 are rendered conductive. The voltage developed at the base of transistor 128 and node 124 is shown as being equal to $V_X + V_{BG}$. Hence, the voltage generated at the emitter of transistor 128, will be equal to $V_{BG} + V_X - V_{BE}$, where $V_{BE}$ is the diode voltage drop of the transistor. If, $V_{BE}$ is made equal to $V_X$, as can be accomplished if the above components are fabricated in monolithic integrated circuit form, the voltage at the emitter of transistor 128 will be equal to the voltage $V_{BG}$ appearing at node 45. This effectively places resistor 130 in parallel with resistor 49 which increases the reference voltage, $V_{REF}$ that appears at node 110. Thus, during the start mode, the reference voltage, $V_{REF}$, is increased to a higher value than during the run mode and a higher start current is provided as previously discussed.

In response to the termination of the start signal and capacitor 58 charging at the rate proportional to current source 64, transistor 120 begins turning off at a rate proportional to its $\beta$ factor times the charging rate of the capacitor. Hence, the current supplied to node 124 also decreases at this time rate. The voltage at the emitter of transistor 128 therefore decreases until the voltage across resistor 130 can no longer support the conduction of this transistor. Transistor 128 will then become nonconductive and effectively disconnect resistor 130. Thus, the reference voltage at terminal 110 will slowly decrease from some well defined maximum value to some well defined minimum value in a predetermined manner to prevent premature firing of the engine. Therefore, the ignition system comprising start-to-run circuit 14 eliminates an undesirous condition which would otherwise occur between as the engine is caused to switch from a start mode to a run mode which could cause premature firing therein.

What has been described is a start-to-run circuit for an electronic ignition system which provides a different magnitude of current during engine starting than during engine running condition. Moreover, the transition between the start current to run current is controlled at a predetermined rate to prevent premature engine firing from occurring.

What is claimed is:

1. In an ignition system suitable to receive timing signals generated in timed relationship to engine rpm for discharging and charging an ignition coil to produce spark to operate the engine, the ignition system including a first circuit responsive to the initiation of each successive timing signal for generating an output signal of a predetermined duration, a charging current circuit coupled between the first circuit and the ignition coil which is rendered conductive in the absence of the output signal from the first circuit for providing current to charge the ignition coil and being rendered nonconductive by the output signal to cause the ignition coil to be discharged, a bias circuit for producing a first potential during normal engine operation, a current limiting circuit coupled to the charging current circuit and receiving the first potential for limiting the magnitude of the charging current to a value determined by said first potential, the improvement comprising in combination:

interrupt circuit means having an input coupled to the output of the first circuit and an output coupled to the current limiting circuit for producing an output signal to cause the current limiting circuit to prevent charging of the ignition coil when the engine rpm is below a predetermined rpm such that engine operation is inhibited; and start-to-run circuit means having an input coupled to said interrupt circuit means and an output coupled to the bias circuit for causing the magnitude of the first potential to be increased to a second potential during starting of the engine such that the current conducted through the ignition coil is increased during engine starting conditions to facilitate engine start-up.

2. The ignition system of claim 1 wherein said interrupt circuit means includes:

current source means for supplying a current of predetermined magnitude;

discharge circuit means coupled between the first circuit and said current source means, said discharge circuit means being rendered conductive by said output signal from said first circuit; and said current source means and said discharge circuit means being coupled to a charge storage means such that said charge storage means is charged and discharged between first and second potential levels during normal engine operation by said current source means and said discharge circuit means respectively, said charge storage means being charged to a potential greater than said first and second potentials when the engine speed is below said predetermined rpm such that said inhibiting output signal is produced by said interrupt circuit.

3. The ignition system of claim 2 including:

switching means coupled to said charge storage means which is responsive to an applied start signal for causing said charge storage means to be discharged to a potential less than said first and second potential while said start signal is being applied; and the bias circuit includes a resistive divider having first and second terminals and an output terminal, said first and second terminals having a predetermined bias potential coupled thereacross during normal engine operation such that the first potential is produced at said output terminal of said resistive divider.

4. The ignition system of claim 3 wherein said interrupt circuit means further includes comparator means having an input coupled to said charge storage means for producing said output signal therefrom when said potential across said charge storage means exceeds said first and second potentials.

5. The ignition system of claim 3 wherein said start-to-run circuit means includes:

comparator means having an input coupled to said charge storage means and being responsive to said charge storage means being discharged by said switching means for producing a current drive signal at an output thereof; and impedance switching circuit coupled between said first and output terminal of said resistive divider of the bias circuit, said impedance switching circuit being responsive to said current drive signal from said comparator means for varying the impedance value of said resistive divider such that the first potential produced by said bias circuit is caused to be increased to said second potential.

6. In an ignition system for charging and discharging an ignition coil to produce spark for operating an engine including circuit means responsive to timing signals generated in timed relationship to the engine rpm for causing discharge of the ignition coil and for producing current for charging the ignition coil, current limiting circuit means responsive to the charging current for limiting the same to a predetermined magnitude, and bias circuit means coupled to said current limiting circuit means for producing a first reference potential of a predetermined magnitude during normal engine operation which is utilized to determine the value at which the current through the ignition coil is limited thereat, the improvement comprising:

the bias circuit including an impedance circuit having a junction terminal at which said first reference potential is produced; and start-to-run circuit means coupled to said impedance circuit and being responsive to a start signal being applied thereto for causing the value of the impedance of said impedance circuit to be varied such that the magnitude of the first reference potential is increased to a second value such that the magnitude of the charging current is increased during the duration of said start signal to facilitate starting of the engine, said start-to-run circuit means being responsive to the termination of said start signal for causing the first reference potential to be decreased to said first value in a predetermined manner to inhibit premature sparking in the engine.

7. The ignition system of claim 6 wherein said start-to-run circuit means includes:

comparator means for providing an output drive signal at an output thereof in response to said start signal;

resistive means having first and second terminals, said first terminal being coupled to said junction terminal of said impedance circuit of the bias circuit means; and switching means being rendered conductive by said output drive signal from said comparator means for short circuiting said resistive means across a portion of the impedance circuit, said switching means being coupled between said second terminal of said resistive means and a first terminal of said impedance circuit and having an input coupled to said output of said comparator means.

8. The ignition system of claim 7 wherein said switching means includes:

first electron control means having first and second electrodes, said first electrode being coupled to said first terminal of said impedance circuit, said second electrode being coupled to said output of said comparator means of said start-to-run circuit means; and second electron control means having first, second and control electrodes, said first electrode being coupled to said second terminal of said resistive means, said second electrode being coupled to a source of operating potential and said control electrode being coupled to said output of said comparator means of said start-to-run circuit means.

9. The ignition system of claim 8 wherein said comparator means includes third electron control means having first, second and control electrodes, said first electrode being coupled to the input of said start-to-run circuit, said second electrode being coupled to said output of said comparator means, said control electrode being coupled to a second reference potential, said third electron control means being rendered conductive by said applied start signal to provide said output drive signal.

10. The ignition system of claim 6 further including in combination interrupt circuit means coupled between the circuit means for discharging and charging the ignition coil and the current limiting circuit means for providing an output signal that is applied to the current limiting circuit means to inhibit charging of the ignition coil when the engine rpm is below a predetermined rpm, said interrupt circuit means including charge storage means, and circuit means responsive to an output signal provided by said circuit means for discharging and charging the ignition coil for charging and discharging said charge storage means between first and second potential levels during normal engine operation above said predetermined rpm, said circuit means for charging and discharging said storage means charging said charge storage means to a greater potential than said first and second potential levels when the engine rpm is below said predetermined rpm such that the output signal is produced and charging current through the ignition coil is inhibited.

11. The ignition system of claim 10 wherein said circuit means for charging and discharging said charge storage means includes fourth electron control means having first, second and control electrodes, said first electrode being coupled to a ground reference potential, said second electrode being coupled to said charge storage means, said control electrodes being coupled to the circuit means for discharging and charging ignition coil and current source means coupled to said second electrode of said fourth electron control means.

12. A start-to-run circuit to be used in an ignition system for producing a starting current through an ignition coil having a magnitude of greater value than current conducted through the ignition coil during normal operation, the ignition system including a current interrupt circuit for preventing engine operation below a predetermined engine speed, and a bias circuit having a resistor divider circuit for producing at a junction node of the divider circuit an operating potential of a first magnitude that is utilized to cause the current through the coil to be limited to a predetermined value during normal operation, comprising:

circuit means responsive to an applied start signal for producing at an output thereof a switching signal;

switching circuit means coupled to the output of said circuit means and including impedance means coupled to the junction node of the resistor divider, said switching circuit means being responsive to said switching signal for short circuiting said impedance means in parallel across a portion of the resistor divider such that the operating potential provided by the bias circuit is increased during application of said start signal and the current is increased through the ignition coil to facilitate engine start-up.

13. The circuit of claim 12 wherein said circuit means for producing a control switching signal includes:

first electron control means having first, second and control terminals, said control terminal being adapted to receive a first reference bias potential, said first electrode being coupled to an input of said circuit means for producing a switching signal; and second electron control means having first, second third and control electrodes, said control electrode being coupled to said second electrode thereof, said first electrode being adapted to receive a second bias potential, said second electrode being coupled to said second electrode of said first electron control means, and said third electrode being coupled to an input of said switching circuit means.

14. The circuit of claim 13 wherein said switching circuit means includes:

third electron control means having first and second electrodes, said first electrode being adapted to be coupled to an output terminal of the start-to-run circuit to the bias circuit, said second electrode being coupled to said third electrode of said second electron control means;

fourth electron control means having first, second and control electrodes, said control electrode being coupled to said third electrode of said second electron control means, said second electrode being coupled to a power supply voltage;

resistive means having first and second terminals, said first terminal being coupled to said first electrode of said fourth electron control means, said second terminal being adapted to be connected to a second output terminal of the start-run-circuit which is coupled to the bias circuit; and the magnitude of the impedance appearing across said first and second output terminals being controlled by said control signal.

15. A start-to-run circuit suitable to be provided in monolithic integrated circuit form for an electronic ignition system comprising:

semiconductor comparator means having first and second inputs and an output, said first input being adapted to receive a variable input bias potential, said second input being adapted to receive a fixed first bias potential, said comparator means being rendered conductive in response to the magnitude of said variable input bias potential becoming less than the magnitude of said fixed first bias potential to produce a control signal at said output thereof; and impedance switch means having an input, first and second outputs, said input being coupled to said output of said comparator means, and the magnitude of impedance appearing across said first and second outputs being varied in response to the control signal applied to said input.

16. The start-to-run circuit of claim 15 wherein said comparator means includes:

first electron control means having first, second, and third electrodes, said first electrode being adapted to receive said variable bias potential, said control electrode being adapted to receive said fixed bias potential; and second electron control means having first, second, third and control electrodes, said control electrode being connected to said second electrode, said first electrode being adapted to receive a second bias potential, said second electrode being coupled to said second electrode of said first electron control means, and said third electrode being connected to the output of said comparator means.

17. The start-to-run circuit of claim 16, wherein said impedance switch means includes third electron control means having first and second electrodes, said second electrode being coupled to said output of said semiconductor comparator means, and said first electrode being adapted to be the first output of the start-to-run circuit;

fourth electron control means having first, second, and control electrodes, said control electrode being coupled to the output of said semiconductor comparator means, said second electrodes being coupled to another bias potential; and resistive means coupled between said first electrode of said fourth electron control means and said second output terminal of the start-to-run circuit.

* * * * *